US005798675A

United States Patent [19]

Drach

[11] Patent Number: 5,798,675

[45] Date of Patent: Aug. 25, 1998

[54] CONTINUOUSLY VARIABLE PHASE-SHIFTER FOR ELECTRICALLY DOWN-TILTING AN ANTENNA

[75] Inventor: William C. Drach, Neptune, N.J.

[73] Assignee: Radio Frequency Systems, Inc., Marlboro, N.J.

[21] Appl. No.: 805,589

[22] Filed: Feb. 25, 1997

[51] Int. Cl.[6] ..... H01P 1/18

[52] U.S. Cl. ..... 333/161; 343/850

[58] Field of Search ..... 333/156, 159, 333/161; 343/850; 342/372, 375

[56] References Cited

U.S. PATENT DOCUMENTS

| | | | |
|---|---|---|---|
| 3,005,168 | 10/1961 | Fye | 333/161 |
| 3,114,121 | 12/1963 | Jordan | 333/161 |
| 3,139,597 | 6/1964 | French et al. | 333/161 |
| 3,181,091 | 4/1965 | Augustine et al. | 333/159 |
| 3,946,396 | 3/1976 | Smith et al. | 343/753 |
| 4,129,872 | 12/1978 | Toman | 343/768 |
| 5,281,974 | 1/1994 | Kuramoto et al. | 343/700 MS |
| 5,343,173 | 8/1994 | Balodis et al. | 333/126 |
| 5,504,466 | 4/1996 | Chan-Son-Lint et al. | 333/159 |
| 5,512,914 | 4/1996 | Hadzoglou et al. | 343/816 |

OTHER PUBLICATIONS

"Cellular Control Channel Capacity: Evaluation and Enhancement," by Saleh Faruque, 1992 IEEE, pp. 0400–0404.

"Electrical Downtilt Through Beam-Steering Versus Mechanical Downtilt," by Gary Wilson 1992 IEEE, pp. 1–4.

"Electrically Tilted Panel Antennas," IMCE Engineering Meeting, Mar. 23, 1993 pp. 1–10.

"Second Generation Variable Electrical Tilt Panel Antenna," CTIA Technical Meeting, Mar. 4, 1994, pp. 1–10.

"Ongoing Development of Electrically Tilted Panels," MTS Engineering Meeting, Mar. 28, 1996, pp. 1–19.

"Effects of Antenna Height, Antenna Gain, and Pattern Downtilting for Cellular Mobile Radio," by E. Benner and A.B. Sessay, IEEE Transactions on Vehicular Technology, vol. 45, No. 2, May, 1996, pp. 217–224.

"Controlling the Coverage Area of a Microcell," by A.A. Arowojolu and A.M.D. Turkmani, University of Liverpool, UK, APS 1993, pp. 72–75.

*Primary Examiner*—Seungsook Ham

*Attorney, Agent, or Firm*—Ware, Fressola, Van Der Sluys & Adolphson LLP

[57] ABSTRACT

A phase shifter for electrically adjusting the down-tilt of an antenna, based on rotating at least one phase wheel having a specially shaped dielectric. Each phase wheel is rotatably mounted between a stripline and the metallic ground plane of a feed system for an RF signal communicating the RF signal between each element of the antenna and a common terminal. The dielectric distributed on each phase wheel is shaped so that as the phase wheel is turned mechanically, the amount of dielectric directly beneath the stripline and above the metallic ground plane either increases or decreases in some proportion to the amount (angular displacement) the wheel is turned. All the phase wheels used in a system can be arranged, oriented, and tractively coupled so as to rotate in synchrony under the action of a single drive, which may itself be driven by a stepper motor for accurate, fine control. The phase wheels provide for continuous adjustment of the down-tilt of an antenna without having to convert between rotational and linear motion in moving dielectric into or out of position between the stripline and metallic ground plane.

5 Claims, 3 Drawing Sheets

CONTINUOUSLY VARIABLE PHASE-SHIFTER FOR ELECTRICALLY DOWN-TILTING AN ANTENNA

TECHNICAL FIELD

The present invention pertains to the field of antennas. More particularly, this invention relates to electrically down-tilting the radiation pattern associated with a broadcast antenna, or, equivalently, electrically reorienting a receive antenna.

BACKGROUND OF THE INVENTION

It is sometimes desirable to adjust the orientation of a radiation pattern of a broadcast antenna. In particular, an adjustment downward is sometimes advantageous where a broadcast antenna is positioned at a higher altitude than other antennas that communicate with the broadcast antenna. This down-tilting of the radiation pattern alters the coverage angle and may reduce interference with nearby broadcast antennas, and may enhance communications with mobile users situated in valleys below the broadcast antenna. See "Electrical Downtilt Through Beam Steering Versus Mechanical Downtilt," by G. Wilson, IEEE 07803-0673-2/92, Vehicular Technology Conference 1992.

There are several approaches used to down-tilt the radiation pattern from an antenna. Besides actually tilting the entire antenna, which is generally regarded as too rigid an approach and too expensive, there is the approach that electrically down-tilts the pattern by adjusting the relative phases of the radiation associated with each of several elements of a multi-element antenna.

Among these electrical down-tilt methods is a capacitive coupling method, in which an adjustable capacitance is placed in series with the transmission line feeding each element of the antenna array, thus causing the desired phase shifts. Another such approach is to use different lengths of transmission lines for feeding the different elements; this produces a permanent electrical down-tilt. A third approach is to provide continuously adjustable down-tilting by mechanically varying the amount of dielectric material included in the transmission line, usually using a rack and pinion gear assembly.

Producing a fixed electrical phase shift is too rigid an approach for many applications. A fixed electrical phase shift solution cannot be altered to fit changing circumstances, and does not allow for optimizing the carrier-to-interference ratio.

Of the state-of-the art continuously variable electrical phase-shifting methods, the capacitive coupling method produces intermodulation products, and is generally only good for omni-directional antenna patterns. Existing methods of providing continuous phase shifting, for example using a rack and pinion assembly, are mechanically complex, and so are often unreliable and expensive. The complexity in these methods stems from translating rotational to linear motion in moving dielectric into or out of the transmission line.

It is well known in the art that a receive antenna responds to a radiation pattern in a way that is directly related to the radiation pattern the antenna would broadcast. Thus, the methods associated with down-tilting a broadcast antenna are equally applicable to adjusting a receive antenna to improve its reception in a particular direction.

SUMMARY OF THE INVENTION

The present invention is a continuously variable phase-shifter that electrically reorients the radiation pattern of a broadcast antenna by introducing more or less dielectric into the transmission line feeding the elements of the antenna, without ever converting rotational motion to linear motion. By avoiding having to convert linear motion to rotational motion in repositioning the dielectric material, the present invention overcomes the shortcomings of the prior art.

A phase-shifter according to the present invention is capable of varying continuously the down-tilt of a radiation pattern associated with an antenna, the radiation pattern comprising an RF signal, the antenna having a plurality of elements and having an element terminal for each element, and further having a feed system for communicating the RF signal between each element terminal and a common feed terminal, the feed system including a stripline spaced above a metallic ground plane. A phase shifter according to the present invention comprises:

- a phase wheel having a shaped dielectric distributed throughout, and rotatably positioned between the metallic ground plane and stripline so that, depending on the orientation of the phase wheel relative to the stripline, a particular amount of dielectric lies between the stripline and the metallic ground plane; and
- means for rotating the phase wheel relative to the stripline, whereby the amount of dielectric directly beneath the stripline and above the metallic ground plane can be varied, thereby causing the overall radiation pattern to vary in its down-tilt, the variation in down-tilting thus being produced by purely rotational mechanical motion.

Also according to the present invention, a phase-shifter may comprise additional phase wheels, each having distributed on it a shaped dielectric, each phase wheel rotatably positioned between the stripline and metallic ground plane, each phase wheel associated with one of the antenna elements, each phase wheel in tractive engagement with at least one of the other phase wheels in such an arrangement that all of the phase wheels are tractively coupled, and also comprising a means for turning one of the phase wheels, whereby all of the phase wheels are turned in synchrony, with each varying, as it is turned, the amount of dielectric directly beneath the stripline. In addition, all the phase wheels used in a system can be arranged, oriented, and tractively coupled so as to rotate in synchrony under the action of a single drive, which may itself be driven by a stepper motor for accurate, fine control.

Advantageously, throughout each phase wheel of a phase-shifter according to the present invention, the shaped dielectric is distributed so that as the phase wheel is turned, the amount of dielectric directly beneath the stripline, and between the stripline and the metallic ground plane, changes in direct proportion to an angular displacement of the phase wheel.

BRIEF DESCRIPTION OF THE DRAWINGS

The above features and advantages of the invention will become apparent from a consideration of the subsequent detailed description presented in connection with accompanying drawings, in which.

DESCRIPTION OF THE PREFERRED EMBODIMENT

The detailed description will focus on the use of the present invention with a multi-element antenna broadcasting an RF signal. It should be understood, however, that the present invention is in fact intended equally for both broadcast and receive functions of an antenna system, and a likely use is as a component of a cellular communication base station antenna system. In that application, the phase shifter of the present invention would be suitable for electrically down-tilting the base station antenna over a band of frequencies in width perhaps as much as 20% of the central frequency.

Figure 1C:
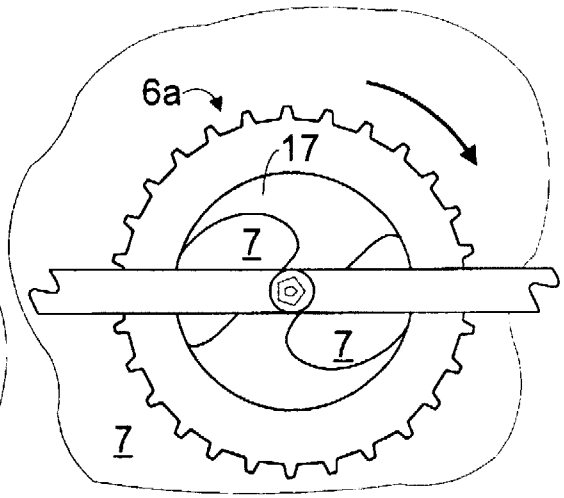
FIGS. 1*a–c* show a phase wheel in three different orientations with respect to a stripline, which is part of the transmission line feeding an antenna element.
Figure 1B:
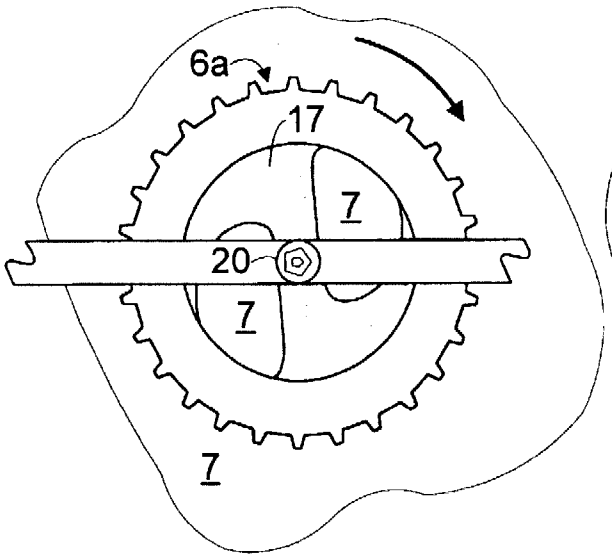
Figure 1A:
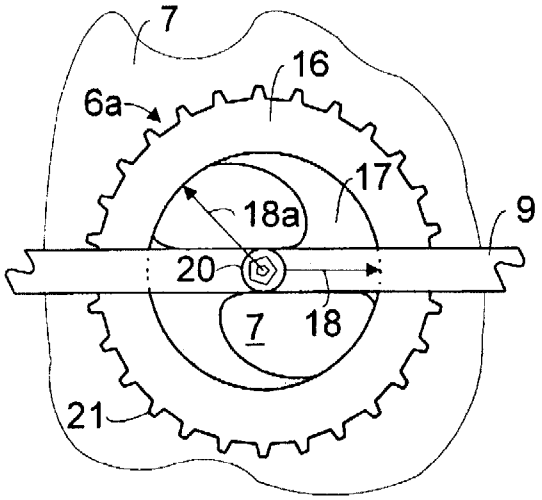

Referring now to FIGS. 1*a–c*, a phase wheel 6*a* is shown mounted above a metallic ground plane 7 beneath a stripline 9 of a transmission line feeding an element of an antenna. The phase wheel 6*a* holds a specially shaped dielectric 17. As the phase wheel 6*a* is rotated by means of its gear teeth 21, more or less of the shaped dielectric 17 is positioned beneath the stripline 9. In fact, the shaped dielectric 17, in the preferred embodiment, is distributed on the phase wheel 6*a* so that as the phase wheel 6*a* is rotated, the dielectric beneath the stripline varies directly with an angular displacement (rotation by turning) of the phase wheel, the amount increasing or decreasing depending on the initial and final orientation of the phase wheel.

When the phase shifter of the present invention is used in an antenna system for broadcasting an RF signal, the electric field of the RF signal to be broadcast is concentrated between the metallic ground plane 7 and the stripline 9. When a phase wheel is rotated so that more dielectric is positioned between the stripline and the ground plane, the RF signal is delayed, i.e., it is phase-shifted. Thus, the phase wheel 6*a*, in the orientation illustrated in FIG. 1*a*, produces the greatest phase shift since as much dielectric as possible is directly beneath the stripline. In the orientation shown in FIG. 1*b*, the phase wheel 6*a* produces less phase shift; and the phase wheel 6*a* in the orientation shown in FIG. 1*c* produces the least phase shift of the three orientations.

In the preferred embodiment, a phase wheel 6*a* is made as one piece by injection molding. The phase wheel has an annular ring 16 intended to hold the shaped dielectric 17 and to provide strength enough to rotate the phase wheel by its geared teeth 21. Thus, the shaped dielectric 17 is in addition to the dielectric of the annular ring 16, which, in the preferred embodiment, is the same material since the entire phase wheel is injection molded. In the preferred embodiment, the thickness of the shaped dielectric 17 is approximately three times that of the annular ring 16. This thickness is enough for some structural strength, in particular, it provides adequate strength for driving the phase wheel by its gear teeth, yet thin enough that the effect of the annular ring dielectric may be neglected in approximating the phase shift caused by a phase wheel. In other embodiments, the phase wheel annular ring is made of material different from the shaped dielectric, and for material that has a dielectric constant near air, the thickness is irrelevant in connection with producing a phase shift.

It is important that the shaped dielectric 17 be sized according to the wavelength of the RF signal in such a way as to reduce or eliminate reflected waves that occur whenever the RF signal encounters a change in impedance, i.e., whenever the RF signal first encounters or leaves the shaped dielectric. In the preferred embodiment, this is achieved by forming the phase wheel so that not only does it have an outer annular ring 16, but also an inner core 20, with none of the shaped dielectric 17. With this configuration, when a phase wheel is oriented to provide some amount of phase shift of an RF signal, in traversing the phase wheel, the RF signal must enter and leave the shaped dielectric twice, once before the core, and once afterward. If each span of shaped dielectric encountered by the RF signal is one-quarter of a wavelength of the RF signal in that span (or odd integral multiples thereof), then, for a given span, the wave reflected on leaving is 180 degrees out of phase with respect to the wave reflected on entering the span, and the two waves cancel, producing no reflection.

When the phase wheel is rotated to produce minimum phase shift, the distance between the two starting points of the dielectric inside diameter of the annular ring is made to be one eighth the wavelength of the RF signal in whatever material occupies the volume between the stripline 9 and the metallic ground plane 7 outside of the shaped dielectric. In the preferred embodiment, this is air.

Thus, in the preferred embodiment, the radius 18*a* in FIG. 1 should be one-eighth the wavelength of the RF signal in air, because in the preferred embodiment the space outside of the shaped dielectric, between the stripline and the metallic ground plane, is filled with air. (In other embodiments, this space may be filled with other dielectric materials.) In addition, the radius 18 shown in FIG. 1 should be one-quarter of the wavelength of the RF signal in the shaped dielectric 17.

In arranging for this cancellation of reflected waves, the value of the dielectric constant of the shaped dielectric is taken into account. In FIGS. 1*a–c* and FIG. 2, the shaped dielectric 17 fits inside the annular ring 16 having a constant inside radius 18*a*. This occurs only when using a shaped dielectric 17 having a dielectric constant equal to the value 4, because of requiring, in the design of a phase wheel, that the diameter across the inside of the annular ring 16 be one-quarter of a wavelength of the RF signal in air, and also that this same diameter be one-half of the wavelength of the RF signal in the shaped dielectric. (This second requirement neglects the size of the core 20, and follows from the requirement that at maximum phase shift the radius 18 be one-quarter of the wavelength of the RF signal to avoid reflected waves.) Thus, for a round shaped dielectric 17, as shown in FIG. 1, we require that $$D_{at\ min\ imum} = \frac{\lambda_{air}}{4} \text{ and } D_{at\ max\ imum} = \frac{\lambda_{dielectric}}{2}$$

and for these two diameters to be the same, resulting in a round shaped dielectric, we therefore require that $$\frac{\lambda_{air}}{4} = \frac{\lambda_{dielectric}}{2}$$

which yields the requirement that the shaped dielectric have a dielectric constant $K_e=4$.

Figure 3:
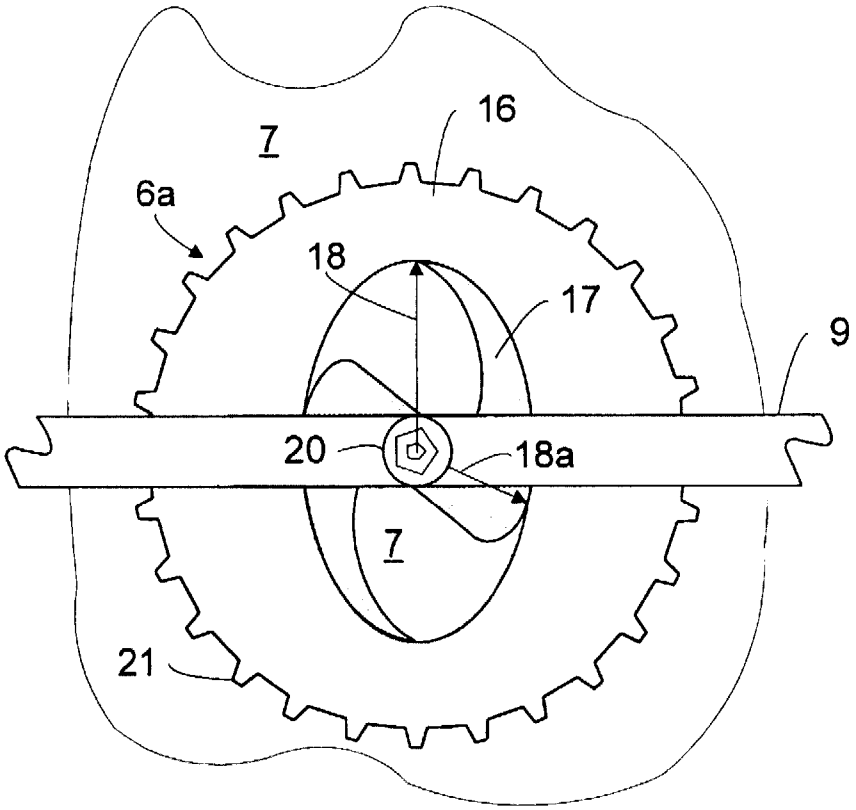
FIGS. 3 shows phase wheel having a dielectric with a dielectric constant of value greater than 4.

If the value is greater than 4, the shaped dielectric spans a smaller length, as shown in FIG. 3. If the value is less than four, the outer perimeter of the shaped dielectric deforms from circular in the opposite sense, so that it extends beyond the radius at minimum phase shift (radius 18*a* in FIG. 3).

It is believed also possible to sometimes meet the antenna down-tilt requirements using phase wheels having shaped dielectrics with values other than 4, and yet that are not deformed either as in FIG. 3, or deformed in the opposite sense. This is done by designing the core 20 to vary in diameter so as to compensate for the two-fold requirement that the extent 18 be one-quarter of a wavelength of the RF signal in the dielectric, and that the extent 18*a* be one-eighth of a wavelength of the RF signal in air. For example, to avoid deforming the shaped dielectric as in FIG. 3, the core 20 would be made larger in the orientation corresponding to maximum phase shift.

With the maximum phase shift per phase wheel taken to correspond to a quarter of the wavelength of the RF signal in the dielectric, the required dielectric constant $K_e$ is:

$$K_e=[\pi/(\pi-\delta)]^2$$

in which $\delta$ is the maximum phase shift. For example, if the desired maximum phase shift is $\delta=50°$ (0.87 radians), the dielectric constant $K_e$ of the shaped dielectric 17 must be approximately 1.92.

Figure 2:
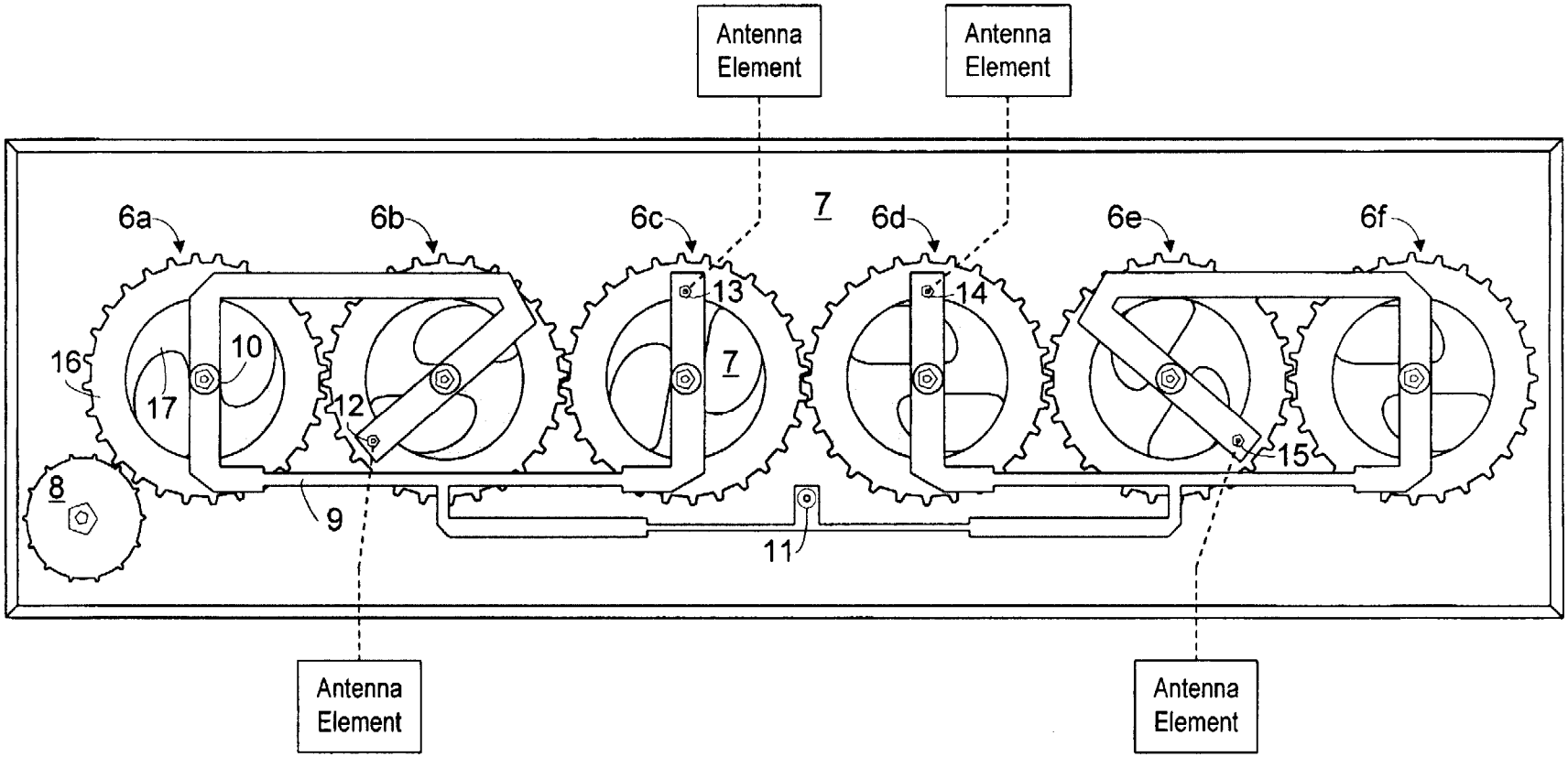
FIGS. 2 shows an embodiment of the present invention for a four-element antenna, with six phase wheels all turned by a single drive gear.

Referring now to FIG. 2, an assembly of six phase wheels 6*a–f*, geared to be mechanically synchronized, and all turned by a single drive gear 8, are shown connected to input feed 11 to feed four elements of a planar antenna array (not shown) through outputs 12–15, each output feeding a different antenna element. For accurate, fine control, the drive gear 8 is itself turned by a stepper motor.

Each phase wheel 6*a–f* is fastened to the metallic ground plane 7 using a dielectric fastener 10. The RF signal at output 12 is the most phase-shifted because the RF signal encounters the dielectric spanning the entire length of the stripline on top of the left-most phase wheel 6*a*, and then some additional dielectric beneath the stripline spanning the phase wheel 6*b*, second from left. In propagating from the input feed 11 to the output 13, the RF signal encounters only the shaped dielectric 17 beneath the stripline spanning the phase wheel 6*c*, and is therefore phase-shifted less than the RF signal arriving at output 12. The RF signal at output 14 is the least phase-shifted.

With the phase wheels 6*a–f* arranged together as shown in FIG. 2, because the dielectrics cause a phase difference between the RF signal issuing from the different antenna elements, the antenna beam is tilted up or down. The tilt, $\theta_r$, for the assembly of FIG. 2, can be determined using the formula $$\theta_r=\pi/2-\cos^{-1}[\delta/(2\pi l)]$$

where l is the antenna element spacing.

It is possible to satisfy the down-tilting requirement of a four-element antenna with other than the particular combination of the six particular phase wheels used in the preferred embodiment, illustrated in FIG. 2. In this preferred embodiment, each phase wheel uses a shaped dielectric having a dielectric constant of value 4, and thus each phase wheel produces a maximum phase shift of 90°, and its shaped dielectric 17 is round, in the sense illustrated in FIGS. 1*a–c* and FIG. 2.

The phase shifter of the present invention can be used in antennas with many different types of radiating elements, and can be used to tilt the radiation patterns of either uni-directional or omni-directional antennas. Although the preferred embodiment uses six phase wheels for a four-element planar antenna, the present invention is not limited to using six phase wheels for a four-element array, and is not limited to use with an antenna having four elements. In addition, this arrangement for continuously varying the phase shift of an antenna element can be used in an antenna system using a feed system that is series, binary, or any combination of series and binary feed systems.

Although in the present embodiment the shaped dielectric is formed to provide a linear relation between rotation and amount of dielectric beneath the stripline, the shape can be varied to produce other kinds of relationship. Also, as would be clear to one skilled in the art, a phase wheel according to the present invention can be fabricated from any type of dielectric material, including but not limited to plastic, ceramic and composite material.

It is to be understood that the above described arrangements are only illustrative of the application of the principles of the present invention. In particular, the phase-shifter of the present invention could be used with equal advantage in either a broadcast or receiver communication system. Numerous modifications and alternative arrangements may be devised by those skilled in the art without departing from the spirit and scope of the present invention, and the appended claims are intended to cover such modifications and arrangements.

What is claimed is:

1. A phase-shifter capable of varying continuously the down-tilt of a radiation pattern associated with an antenna for an RF signal, the antenna having a plurality of antenna elements and having an element terminal (12–15) for each antenna element, and further having a feed system (9 and 7) for communicating the RF signal between each element terminal (12–15) and a common feed terminal (11), the feed system including a stripline (9) spaced above a metallic ground plane (7), the phase-shifter comprising:

a plurality of phase wheels (6*a–f*) each having a shaped dielectric (17) distributed throughout, and each rotatably positioned between the metallic ground plane (7) and the stripline (9) wherein each phase wheel is held in tractive engagement with at least one of the other phase wheels in such an arrangement that all of the phase wheels are tractively coupled one to another; and means (8) for rotating one of the phase wheels (6*a–f*) relative to the stripline (9), wherebv all of the phase wheels are turned in synchrony, with each varying, as it is turned, the amount of dielectric directly beneath the stripline;

thereby causing the overall radiation pattern to vary in its down-tilt, the variation in down-tilting thus being produced by purely rotational mechanical motion.

2. A phase-shifter as claimed in claim 1, wherein, on each phase wheel (6*a–f*), the shaped dielectric (17) is distributed so that as any one of the phase wheels is turned, the amount of dielectric directly beneath the stripline (9), and between the stripline (9) and the metallic ground plane (7), changes in direct proportion to an angular displacement of the phase wheel.

3. A phase-shifter as claimed in claim 1, wherein the shaped dielectric (17) is chosen to have a dielectric constant given by $$K_e=[\pi/(\pi-\delta)]^2$$

where $\delta$ is the desired maximum phase shift that can be produced by the phase wheel.

4. A phase-shifter as claimed in claim 1, wherein the shaped dielectric (17) is distributed on each phase wheel (6*a–f*) so that when one or more of the phase wheels is oriented for maximum phase shift, positioning at least one span of the shaped dielectric directly beneath the stripline (9), the span of the shaped dielectric beneath each of the one or more phase wheels extends directly beneath the stripline over a length equal to an odd-integral multiple of one-quarter of the wavelength of the RF signal in the shaped dielectric, thereby providing for mutual cancellation of the two reflected waves produced as the RF signal traverses the span of the shaped dielectric.

5. A phase-shifter as claimed in claim 1, wherein the shaped dielectric (17) is distributed on each phase wheel (6*a–f*) so that when one or more of the phase wheels is oriented for minimum phase shift, two spans of the shaped dielectric are in position to be moved directly beneath the stripline (9) with any slight further turning of the phase wheel, and are separated by a medium, having a dielectric constant approximately the same as air, extending directly beneath the stripline over a length equal to an odd-integral multiple of one-quarter of the wavelength of the RF signal in the medium.

* * * * *